US005080510A

United States Patent [19]

Stempfle et al.

[11] Patent Number: 5,080,510

[45] Date of Patent: Jan. 14, 1992

[54] MATRIX PRINT HEAD WITH AN ELECTROMAGNETIC COIL SUPPORT

[75] Inventors: Johann Stempfle, Pfaffenhofen; Bernd Gugel, Ulm-Einsingen, both of Fed. Rep. of Germany

[73] Assignee: Mannesmann Aktiengesellschaft, Düsseldorf, Fed. Rep. of Germany

[21] Appl. No.: 487,545

[22] Filed: Mar. 1, 1990

[30] Foreign Application Priority Data

Mar. 1, 1989 [EP] European Pat. Off. ..... 89730052.1

[51] Int. Cl.[5] ..... B41J 2/27

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,214,836 | 7/1980 | Wang | 400/124 |
| 4,218,149 | 8/1980 | Okada | 400/124 |
| 4,260,270 | 4/1981 | Cavallari | 400/124 |
| 4,661,002 | 4/1987 | Ara | 400/124 |
| 4,929,101 | 5/1990 | Ochiai et al. | 400/124 |

FOREIGN PATENT DOCUMENTS

| | | |
|---|---|---|
| 0041126 | 12/1981 | European Pat. Off. . |
| 8403253 | 8/1984 | PCT Int'l Appl. . |

*Primary Examiner*—Edgar S. Burr
*Assistant Examiner*—John S. Hilten
*Attorney, Agent, or Firm*—Horst M. Kasper

[57] ABSTRACT

An electromagnetic coil support (7) forms a magnet yoke ring for, for example, 18 or 24 print element systems of a matrix print head. In each case the magnet yoke body (9) with yoke feet (16) is attached in polygonal openings (19) of the annular electromagnetic coil support (7) and is directed radially toward the center of the electromagnetic coil support (7). In order to achieve a smallest possible diameter for the matrix print head in cases where the number of print element systems amounts to over 14, for example, 18 or 24, and a simultaneously safe attachment of the magnet yoke bodies (9) to the base plate, a larger rest face (18*a*) of the magnet yoke body (9) follows to the smaller yoke foot (16) in cross-section (16*a*) as compared to the cross-section (17) of the magnet yoke body (9). The yoke foot (16) is glued into the polygonal openings (19) of the electromagnetic coil support (7).

24 Claims, 2 Drawing Sheets

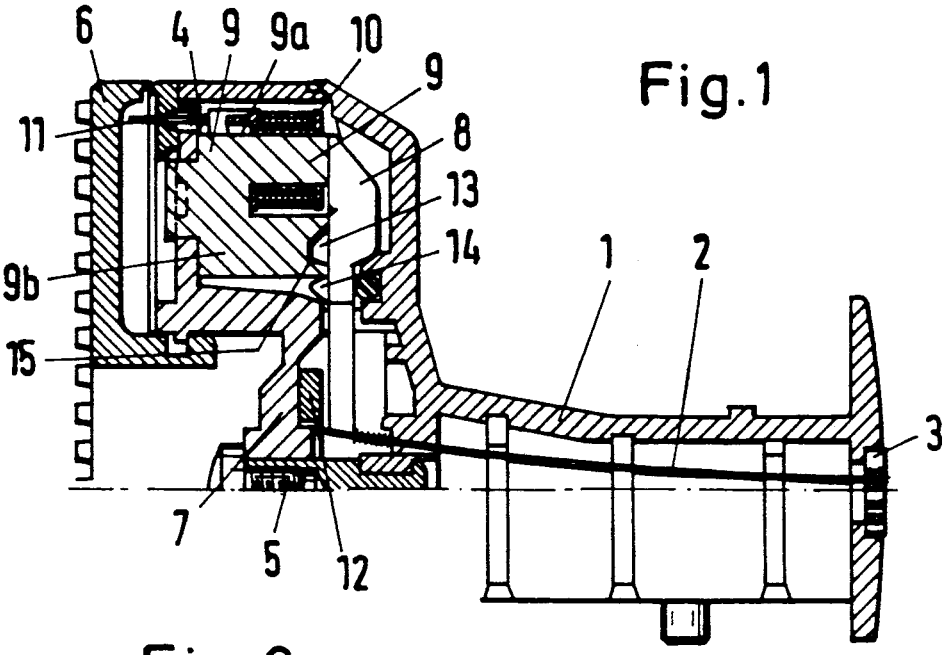
Fig.1
Fig.2
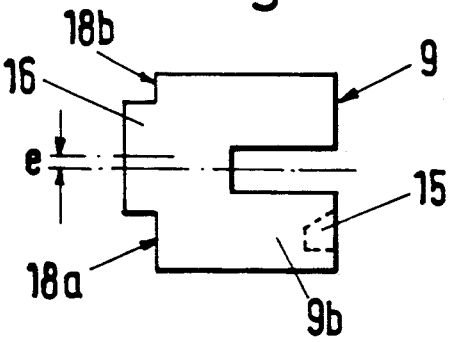
Fig.5
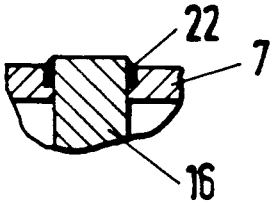
Fig.3
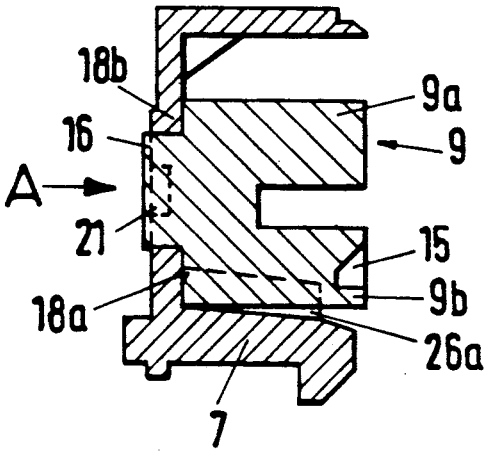
Fig.4
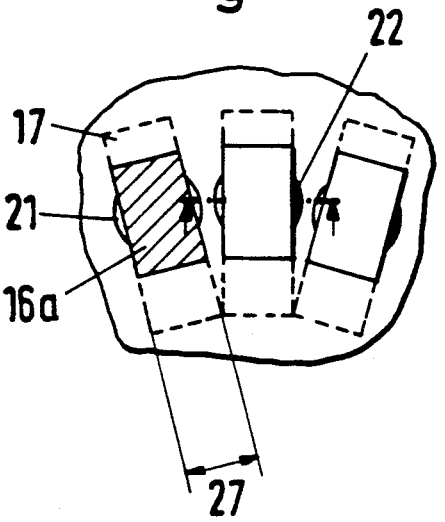

MATRIX PRINT HEAD WITH AN ELECTROMAGNETIC COIL SUPPORT

BACKGROUND OF THE INVENTION

1. Field of the Invention

The invention relates to a matrix print head with an electromagnetic coil support including a magnet yoke ring adapted to for example, 18 or 24 print element systems, where in each case the magnet yoke bodies are attached with yoke feet in polygonal openings of an annular electromagnetic coil support and are directed radially toward the center of the electromagnetic coil support.

2. Description of the Background of the Invention Including Prior Art

The magnet yoke bodies can be constructed together with the electromagnetic coil support in one piece such that the economy of the production becomes more important than the expected tool costs for the processing tools.

In a case, where individual yoke bodies have to be attached in an annular base body of the electromagnetic coil support, there occur different problems. The base body of the electromagnetic coil support can, for example, be produced of a magnetically non-conductive light metal or of a non-ferromagnetic material, whereas the magnet yoke body is produced of a magnetically highly conductive material, such as, for example, magnetically conductive ferromagnetic sinter materials or materials having soft ferromagnetic properties.

It is known from the German Patent Application Laid Open DE-OS 3,715,304 to support magnet yoke bodies in punch-out structures of the base plate. However, in view of the material technology, the punch-out or stamp-out structures require a minimum distance which allows the stamping-out process. In case the number of the magnet yoke bodies or, respectively, of the magnet systems increases, for example, to above 14 ($2\times7$ print elements), either the overall diameter of the matrix print head becomes larger and thus the matrix print head becomes heavier, or the distance across the circumference of the magnet yoke arrangement becomes so small that stampings in the support plate of the electromagnetic coil support are no longer possible. In addition, the attachment of the magnet yoke body becomes a problem.

SUMMARY OF THE INVENTION

1. Purposes of the Invention

It is an object of the present invention to achieve a smallest possible diameter of the matrix print head in case the number of magnet systems is higher than 14, for example in print heads with 18 or 24 print elements.

It is a further object of the present invention to achieve, in case of compact matrix print heads, a secure attachment of the magnet yoke bodies to the base plate.

It is yet another object of the present invention to provide a support structure for a magnet yoke which allows a construction within smallest dimensions.

These and other objects and advantages of the present invention will become evident from the description which follows.

2. Brief Description of the Invention

The present invention provides for a matrix print head comprising an annular electromagnetic coil support having polygonal openings and forming a support for a magnet yoke ring for, for example, 18 or 24 print element systems. Magnet yoke bodies, each including a yoke foot and two yoke arms, are attached with the respective yoke foot in polygonal openings of the annular electromagnetic coil support. The magnet yoke bodies are radially directed toward the center of the electromagnetic coil support. The yoke foot, smaller in its cross-section versus the cross-section of the magnet yoke body, is followed and adjoined radially inwardly with a larger rest face than radially outwardly. The yoke foot is adhesively attached in or fixedly pressed into the polygonal openings of the electromagnetic coil support.

Pockets for receiving an adhesive material can be furnished at side edges of the polygonal openings.

The magnet yoke body in each case can be fixed radially inwardly at a central hub of the electromagnetic coil support in a recess of the central hub. The recesses at the central hub can be formed of ribs. The ribs can be disposed at the central hub and arranged parallel to a radial line.

The polygonal openings of the electromagnetic coil support can be precast structures with pockets and can be subsequently finished to preset dimensions by stamping at parallel side delimitations.

In accordance to the invention, it is provided that at the yoke foot, where the cross-section of the yoke foot is smaller than the cross-section of the magnet yoke body, there follows radially inwardly a larger rest face than radially outwardly. The yoke foot is adhesively glued in or pressed into the polygonal openings of the electromagnetic coil support. The magnet yoke bodies can be placed so close together in this structure relative to their width extension that their corner points touch radially inwardly but, on the other hand, that their corner points are radially outwardly so far apart from each other that the coil windings still find sufficient space. This space-saving arrangement is further favored in a radial asymmetrical way by the displacement of the rest face of the magnet yoke around the magnet yoke foot. Advantageously, the attachment of the yoke feet occurs in each case such that each yoke foot is pressed in, in case of a predetermined overdimension, and that it is glued in, in case of a predetermined underdimension.

It is further disclosed that pockets are furnished at the side edges of the openings for receiving adhesive materials, such as glue. In this way, the kind of attachment is also space-saving because the pockets for the adhesive material do not require any special space.

A reinforcement of the attachment and an even more precise fitting of the magnet yoke bodies can further be achieved in that the magnet yoke bodies, in each case, are fixed radially inwardly at a central hub of the electromagnetic coil support in a recess of the central hub.

A further precise fixing of the magnet yoke bodies, which is important for the assembly, the mounting, and for the operational functioning, is achieved in that the recesses at the central hub are furnished by ribs disposed parallel to a radial line direction.

The insertion of the magnet yoke bodies during the assembly is performed very precisely in that, initially, the polygonal openings of the electromagnetic coil support are precast with the pockets and in that, subsequently, the polygonal openings of the electromagnetic coil support are finished by stamping to the predefined dimensions at parallel side delimitations. In this way, smaller tolerances can be maintained.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 1 is a section view of a half of a longitudinal section of a matrix pin print head, FIG. 2 is a schematic side view of a magnet yoke body, FIG. 3 is a sectional view of an electromagnetic coil support together with an inserted magnet yoke body, FIG. 4 is a view from the bottom toward the electromagnetic coil support in the direction A of FIG. 3, FIG. 5 is a partial sectional view through the magnet yoke body and the pockets filled with adhesive material.

DESCRIPTION OF INVENTION AND PREFERRED EMBODIMENT

Figure 6:
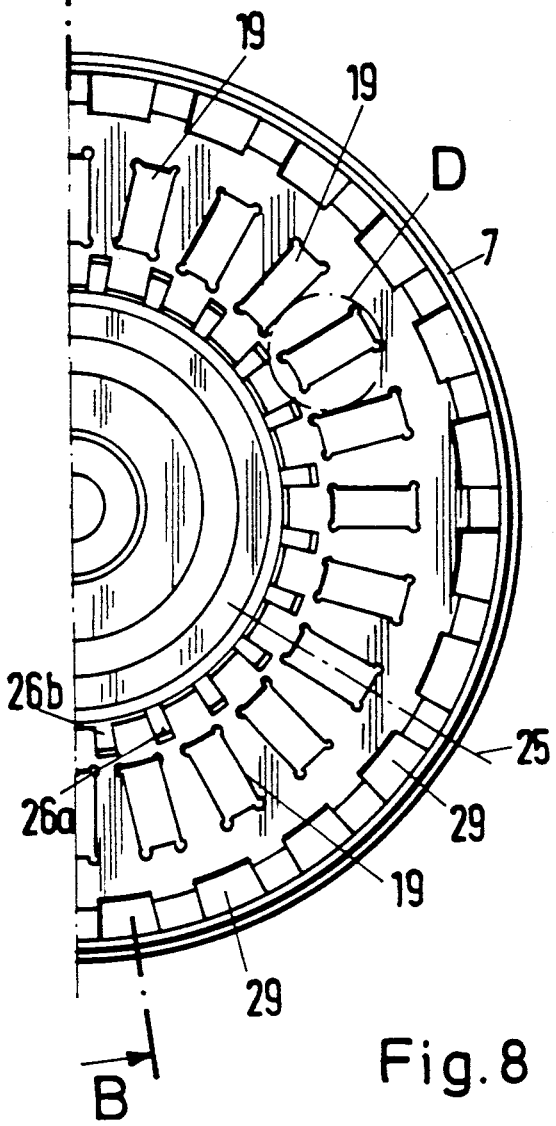
FIG. 6 is a top view onto the electromagnetic coil support cast from aluminum.

In accordance with the present invention, there is provided a matrix print head with an electromagnetic coil support which forms a magnet yoke ring for, for example, 18 or 24 print-element systems. In each case, magnet yoke bodies are attached with yoke feet in polygonal openings of the annular electromagnetic coil support. The magnet yoke bodies are radially directed toward the center of the electromagnetic coil support. The yoke foot 16, smaller in its cross-section 16*a* versus the cross-section 17 of the magnet yoke body 9, is followed inwardly radially with a larger rest face 18*a* than radially outwardly. The yoke foot 16 is adhesively attached in or pressed into the polygonal openings 19 of the electromagnetic coil support 7.

Pockets 21 for an adhesive material 22 can be provided at side edges 20 of the openings 19.

The magnet yoke body 9 in each case can be fixed radially inwardly at a central hub 23 of the electromagnetic coil support 7 in a recess 24 of the central hub 23. The recesses 24 at the central hub 23 can be formed of ribs 26*a*, 26*b* disposed parallel to a radial line 25.

The polygonal openings 19 of the electromagnetic coil support 7 can be precast with pockets 21 and can be subsequently finished by stamping at parallel side delimitations 18 to the preset dimensions.

Figure 7:
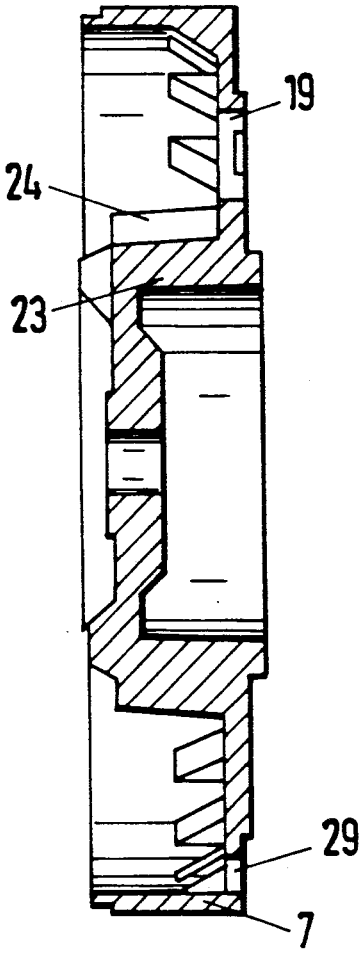
FIG. 7 is an axial cross-sectional view along section B—B of FIG. 6 through the magnetic coil support of FIG. 6.
Figure 8:
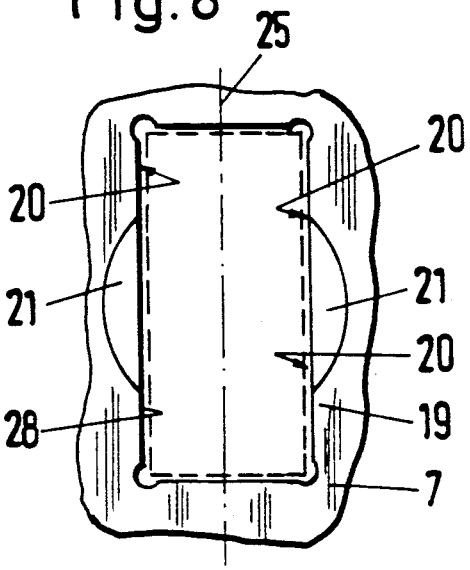
FIG. 8 is a top plan view of a detail D according to FIG. 6, illustrating an enlarged front view of one of the 14, 18, or 24 polygonal openings of the annular electromagnetic coil support.

The matrix pin print head according to FIG. 1 includes a pin guide case 1 with print pins 2, numbering 14, 18, 24 or more, as well as a guide mouthpiece 3. The print pins 2 pass through several slots in the guide mouthpiece 3, and are guided by way of pin guides, for example, rubies, ceramics, plastics, or the like. An electromagnetic coil casing 4 is maintained at a precise distance and attached to the pin guide casing 1 by way of a centrally disposed screw 5, and is closed by way of a cover 6. An electromagnetic coil support 7, illustrated in more detail in FIGS. 6 to 8, is disposed inside of the electromagnetic coil casing 4. Corresponding to the number of print pins 2 with armatures 8, a magnet yoke body 9 is in each case suitably furnished on the electromagnetic coil support 7. In each case an electromagnetic coil 10 with a cable terminal connection 11 is disposed at the radially outer magnet yoke arm 9*a* of the magnet yoke body 9. The armatures 8 are maintained in two positions. The first position represents the rest position at a detent ring 12, and the second position represents the impact position, when one print pin 2 generates a color dot on a recording material carrier, not illustrated, via an ink ribbon, not illustrated.

The armatures 8 can be formed as laminated structures or lamellas. The armatures 8 grip by way of protrusions 13 and 14 into slots 15 or, respectively, hollow spaces of the radially inner magnet yoke arm 9*b*.

The magnet yoke bodies 9, illustrated in FIG. 2, form in each case a yoke foot 16. The cross-section 16*a* of the magnet yoke foot 16, illustrated in FIG. 4, is smaller than the overall cross-section 17 of the magnet yoke body 9. The radially inwardly disposed rest faces 18*a* and the radially outwardly disposed rest faces 18*b* are in this case of different sizes based on the eccentricity "e", illustrated in FIG. 2, in order to effect a displacement of the polygonal openings 19 as far as possible in a radially outward position, where the most space is available. The radially inwardly disposed rest face 18*a* is considerably larger and the radially outwardly disposed rest face 18*b* is smaller, as can be seen in FIG. 2. The electromagnetic coil support 7 receives the yoke feet 16 in the polygonal openings 19. In each case, pockets 21 for adhesive material 22 are disposed at the side edges 20 of the polygonal openings 19. The adhesive material 22 can be recognized with particular clarity in FIGS. 4 and 5. The adhesive material 22 comprises, for example, a commercially available adhesive glue of the brands AV 119, manufactured by Ciba-Geigy Corporation, Ardsley, N.Y., or Loctite 658.

The electromagnetic coil support 7 is produced of a light metal such as, for example, an aluminum alloy and is consequently magnetically non-conductive and does not exhibit ferromagnetic properties. The electromagnetic coil support 7 exhibits a central hub 23. The central hub 23 is furnished with recesses 24 at the side of the polygonal openings 19. A recess 24 is disposed opposite to each opening 19. Such a recess 24 can be formed as a half-round recessed formation or as an acute-angled groove or an acute-angled notch.

The recesses 24 at the central hub 23 are formed by ribs 26*a* and 26*b* parallel to a radial line 25, according to the embodiments of FIGS. 6 and 7. The distance of the parallel ribs 26*a* and 26*b* corresponds in this case to a permissible thickness 27, illustrated in FIG. 4, of the magnet yoke body 9.

The thickness 27 for the magnet yoke bodies 9 is adjusted and tuned to the polygonal openings 19 of the electromagnetic coil support 7. Initially, the polygonal openings 19 are cast with parallel side walls or side edges 20 and, subsequently, the openings are post-treated by stamping to parallel side delimitations 28, as illustrated in FIG. 8. The solid lines of FIG. 8 form the final dimensions, whereas the dashed lines represent the stampings.

As can be recognized from FIGS. 6 and 7, feedthroughs 29 are furnished for the coils.

The width of the rest face 18*a* can be from about 1.2 to 3.0 times, and is preferably from about 1.5 to 2.5 times, the width of the rest face 18*b*. The depth of the yoke foot 16 can be from about 0.8 to 2.0 times the width of the smaller rest face 18*b*, and is preferably from 1.0 to 1.3 times the width of the smaller rest face 18*b*. The magnet body 9 can exhibit an eccentricity whereby the magnet yoke foot 16 is displaced versus the center axis of the magnet body between the arms of the magnet yoke. This eccentricity can be from about 0.05 to 0.2 times the diameter of the yoke foot 16 and is preferably from about 0.1 to 0.15 of the diameter of the yoke foot 16.

The total dimensions of the magnet yoke foot 16 from the end of the magnet yoke foot 16 to the front face oppositely disposed relative to the armature 8 can be from about 0.8 to 1.2 times the outer distances between the magnet yoke arms 9*a*. The polygonal opening 19 can be formed by a superpositioning of a rectangular opening and of a circular opening. The diameter of the circle can be from about 1.2 to 1.8 times the width in the narrow direction of the rectangular opening and is preferably from about 1.3 to 1.5 times the width of the narrower dimension of the rectangular opening. Preferably, the length of the rectangular opening is from about 1.5 to 3.0 times the width of the rectangular section of the polygonal opening 19 and is preferably from about 1.8 to 2.3 times the width of the rectangular opening. The rectangular opening is further advantageously provided at the corners with circular recesses, where the centers of the circles are approximately the corner points of the rectangle, and where the diameters of the circles correspond to from about 0.05 to 0.2, and preferably from about 0.07 to 0.1, of the smaller cross-section width of the rectangular part of the polygonal opening 19. The electromagnetic coil support 7 preferably adjoins the magnet yoke arm 9*a*, not surrounded by a coil, closely, whereas the electromagnetic coil support 7 is provided at a distance from the magnet yoke arm 9*b*, surrounded by the coil, which is from about 1.2 to 2.5 times the width between the magnet yoke arms 9*a*, 9*b* and which is preferably from about 1.6 to 2.0 times the width between the magnet yoke arms 9*a*, 9*b*. The depth of the opening between the arms 9*a*, 9*b* of the magnet yoke 9 can be from about 0.3 to 0.7, and is preferably from about 0.4 to 0.6, times the overall length of the magnet yoke structure in a direction parallel to the arm direction.

It will be understood that each of the elements described above, or two or more together, may also find a useful application in other types of matrix print heads differing from the types described above.

While the invention has been illustrated and described as embodied in the context of a matrix print head with an electromagnetic coil support, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A matrix print head comprising an annular electromagnetic coil support having polygonal openings and forming a support for a magnet yoke ring for energizing print elements;

magnet yoke bodies, each including a yoke foot and two yoke arms and attached with the respective yoke foot in polygonal openings of the annular electromagnetic coil support, wherein the magnet yoke bodies are radially directed toward the center of the electromagnetic coil support, and wherein the yoke foot divides the base of the yoke into a radially inner rest face and a radially outer rest face, wherein the inner rest face is larger than the outer rest face and wherein the yoke foot is adhesively attached in the polygonal openings of the electromagnetic coil support.

2. The matrix print head according to claim 1, wherein:

the yoke foot is fixedly pressed into the polygonal openings of the electromagnetic coil support.

3. The matrix print head according to claim 1, wherein: pockets for receiving an adhesive material are furnished at side edges of the polygonal openings.

4. The matrix print head according to claim 1, further comprising:

a central hub of the electromagnetic coils, wherein the magnet yoke body in each case is fixed radially inwardly at the central hub of the electromagnetic coil support in a recess of the central hub.

5. The matrix print head according to claim 1, further comprising:

ribs disposed at the central hub and arranged parallel to a radial line, wherein the recesses at the central hub are formed of the ribs.

6. The matrix print head according to claim 1, wherein:

the polygonal openings of the electromagnetic coil support are precast structures with pockets and are subsequently finished to preset dimensions by stamping at parallel side delimitations.

7. The matrix print head according to claim 1, wherein:

pockets (21) for an adhesive material (22) are provided at side edges (20) of the openings (19).

8. The matrix print head according to claim 1, wherein:

the magnet yoke body (9) in each case is fixed radially inwardly at a central hub (23) of the electromagnetic coil support (7) in a recess (24) of the central hub (23).

9. The matrix print head according to claim 1, wherein:

the recesses (24) at the central hub (23) are formed of ribs (26*a*, 26*b*) disposed parallel to a radial line (25).

10. The matrix print head according to claim 1, wherein:

the polygonal openings (19) of the electromagnetic coil support (7) are precast with pockets (21) and are subsequently finished by stamping at parallel side delimitations (18) to the preset dimensions.

11. The matrix print head according to claim 1 further including:

a pin guide case;

print pins disposed at the pin guide case;

a guide mouthpiece including several slots and print pin guides and disposed at the pin print case, wherein the print pins pass through the several slots in the guide mouthpiece and wherein the print pins are guided by way of the pin guides;

an electromagnetic coil casing maintained at a precise distance and attached to the pin guide casing by way of a centrally disposed screw; a cover closing electromagnetic coil casing and wherein the electromagnetic coil support is disposed inside of the electromagnetic coil casing; armatures corresponding to the number of print pins associated with the magnet yoke bodies in one to one relationship and wherein the armatures having a first rest position and a second rest position with the first position representing the rest position at a detent ring 12 and the second rest position representing the impact position; electromagnetic coils disposed on the magnet yokes in a one to one relationship; a cable terminal connection disposed at one magnet yoke arm of the two magnet yoke arms, which represents a radially outer magnet yoke arm of the magnet yoke body.

12. The matrix print head according to claim 11 wherein the pin guides are made of a member of the group consisting of rubies, ceramics, plastics, and mixtures thereof;

wherein the armatures are formed as laminated structures and wherein the armatures comprise protrusions for gripping into hollow spaces of on magnet arm of the two magnet arms representing a radially inner magnet yoke arm;

wherein the cross-section of the magnet yoke foot is smaller than an overall cross-section of the magnet yoke body;

wherein one magnet yoke body of the magnet yoke bodies includes a radially inwardly disposed rest face and a radially outwardly disposed rest face and wherein the a radially inwardly disposed rest face and the radially outwardly disposed rest face are of different size based on an eccentricity in order to effect a displacement of polygonal openings as far as possible in a radially outward position;

wherein the radially inwardly disposed rest face is considerably larger and the radially outwardly disposed rest face is smaller on a comparison basis of the rest faces;

wherein the electromagnetic coil support includes polygonal openings for receiving the respective yoke feet;

pockets for adhesive material disposed at side edges of the polygonal openings.

13. The matrix print head according to claim 11 wherein the electromagnetic coil support is produced of a light metal and is magnetically non-conductive and does not exhibit ferromagnetic properties;

wherein the electromagnetic coil support exhibits a central hub and wherein the central hub is furnished with recesses at the side of polygonal openings and wherein a recess is disposed opposite to each polygonal opening.

14. The matrix print head according to claim 13 wherein such recess is formed as an acute-angled groove;

wherein the recesses at the central hub are formed by ribs and parallel to a radial line and wherein the distance of the parallel ribs amounts to a permissible thickness of the magnet yoke body;

wherein the thickness for the magnet yoke bodies is adjusted to an area of the polygonal opening of the electromagnetic coil support and wherein the polygonal openings are cast with parallel side walls or side edges and wherein the polygonal openings are finished by stamping to parallel side delimitations;

wherein the electromagnetic coil supports include feed-throughs for the coils.

15. The matrix print head according to claim 14 wherein the width of the inwardly disposed rest face is from about 1.2 to 3.0 times the width of the outwardly disposed rest face;

wherein the depth of the yoke foot is from about 0.8 to 2.0 times the width of the outer face;

wherein the magnet body exhibits an eccentricity whereby the magnet yoke foot is displaced versus the center axis of the magnet body between the arms of the magnet yoke and wherein this eccentricity amounts to from about 0.05 to 0.2 times the diameter of the yoke foot.

16. The matrix print head according to claim 15 wherein the total dimensions of the magnet yoke foot from an end of the magnet yoke foot to a front face of the magnet foot oppositely disposed relative to the armature are from about 0.8 to 1.2 times the outer distances between the magnet yoke arms;

wherein the polygonal opening is formed by a superpositioning of a rectangular opening and of a circular opening;

wherein the diameter of the circle of the circular opening is from about 1.2 to 1.8 times the width in the narrow direction of the rectangular opening;

wherein the length of the rectangular opening is from about 1.5 to 3.0 times the width of the rectangular section of the polygonal opening and wherein the rectangular opening is disposed at corners of the rectangular opening with circular recesses, wherein the centers of circles of the circular recesses are approximately the corner points of the rectangle, and wherein the diameters of the circles of the circular recesses correspond to from about 0.05 to 0.2 times the smaller cross-section width of the rectangular part of the polygonal opening;

wherein the electromagnetic coil support adjoins closely the magnet yoke arm not surrounded by a coil;

wherein the electromagnetic coil support is provided at a distance from the outer magnet yoke arm surrounded by the coil, which is from about 1.2 to 2.5 times the width between the two magnet yoke arms;

wherein the depth of the opening between the arms of the magnet yoke is from about 0.3 to 0.7 times the overall length of the magnet yoke structure in a direction parallel to the arm direction.

17. The matrix print head according to claim 16 wherein:

the depth of the yoke foot is from 1.0 to 1.3 times the width of the radially outwardly disposed rest face;

wherein the eccentricity of the magnet body is from about 0.1 to 0.15 of the diameter of the yoke foot;

wherein the diameter of the circle of the circular opening is from about 1.3 to 1.5 times the width of the narrower dimension of the rectangular opening;

wherein the length of the rectangular opening is from about 1.8 to 2.3 times the width of the rectangular part of the polygonal opening;

wherein the diameters of the circles of the recesses correspond to from about 0.07 to 0.1 times the smaller cross-section width of the rectangular part of the polygonal opening;

wherein the electromagnetic coil support is provided at a distance from the magnet yoke arm surrounded by the coil, which distance is from about 1.6 to 2.0 times the width between the magnet yoke arms; wherein the depth of the opening between the arms of the magnet yoke is from about 0.4 to 0.6 times the overall length of the magnet yoke structure in a direction parallel to the arm direction.

18. A matrix print head with an electromagnetic coil support which forms a magnet yoke ring for energizing print element systems where, in each case, magnet yoke bodies are attached with yoke feet in polygonal openings of the annular electromagnetic coil support, and which magnet yoke bodies are radially directed toward the center of the electromagnetic coil support, wherein:

the yoke foot (16) divides the base of the yoke into a radially inner rest face and a radially outer rest face, wherein the inner rest face is larger than the outer rest face and wherein the yoke foot is adhesively attached in the polygonal openings (19) of the electromagnetic coil support (7).

19. A matrix print head comprising:

an annular electromagnetic coil support having polygonal openings and forming a support for a magnet yoke ring for energizing print elements;

magnet yoke bodies, each including a yoke foot and two yoke arms and attached with the respective yoke foot in polygonal openings of the annular electromagnetic coil support, wherein the magnet yoke bodies are radially directed toward the center of the electromagnetic coil support, and wherein the yoke foot divides the base of the yoke into a radially inner rest face and a radially outer rest face, wherein the inner rest face is larger than the outer rest face and wherein the yoke foot is pressed into the polygonal openings of the electromagnetic coil support.

20. The matrix print head according to claim 19, wherein:

the yoke foot is fixedly pressed into the polygonal openings of the electromagnetic coil support.

21. The matrix print head according to claim 19, wherein:

pockets for receiving an adhesive material are furnished at side edges of the polygonal openings.

22. The matrix print head according to claim 19, further comprising:

a central hub of the electromagnetic coils, wherein the magnet yoke body in each case is fixed radially inwardly at the central hub of the electromagnetic coil support in a recess of the central hub.

23. The matrix print head according to claim 19, further comprising:

ribs disposed at the central hub and arranged parallel to a radial line, wherein the recesses at the central hub are formed of the ribs.

24. The matrix print head according to claim 19, wherein:

the polygonal openings of the electromagnetic coil support are precast structures with pockets and are subsequently finished to preset dimensions by stamping at parallel side delimitations.

* * * * *